US011859946B2

(12) United States Patent
Davis et al.

(10) Patent No.: US 11,859,946 B2
(45) Date of Patent: Jan. 2, 2024

(54) FIREARM OPTIC WITH LOCKING FEATURE

(71) Applicant: Leupold & Stevens, Inc., Beaverton, OR (US)

(72) Inventors: Matthew C. Davis, Beaverton, OR (US); Todd A. Juenemann, Beaverton, OR (US)

(73) Assignee: Leupold & Stevens, Inc., Beaverton, OR (US)

( * ) Notice: Subject to any disclaimer, the term of this patent is extended or adjusted under 35 U.S.C. 154(b) by 0 days.

(21) Appl. No.: 17/571,590

(22) Filed: Jan. 10, 2022

(65) Prior Publication Data

US 2022/0136803 A1 May 5, 2022

Related U.S. Application Data

(63) Continuation of application No. 16/170,623, filed on Oct. 25, 2018, now Pat. No. 11,248,876.

(60) Provisional application No. 62/577,767, filed on Oct. 27, 2017.

(51) Int. Cl.
*F41G 1/38* (2006.01)

(52) U.S. Cl.
CPC ..... *F41G 1/38* (2013.01)

(58) Field of Classification Search
CPC ... F41G 1/38; F41G 1/00; F41G 1/545; F41G 1/06; G05G 1/08; G05G 1/10; G02B 23/00; G02B 23/14; G02B 23/16; G03B 13/02
USPC ..... 359/429
See application file for complete search history.

(56) References Cited

U.S. PATENT DOCUMENTS

| | | | | |
|---|---|---|---|---|
| 6,691,447 | B1 * | 2/2004 | Otteman | F41G 1/38 42/129 |
| 7,827,723 | B1 | 11/2010 | Zaderey | |
| 8,006,429 | B2 | 8/2011 | Windauer | |
| 8,166,696 | B2 | 5/2012 | Hamilton | |
| 8,516,736 | B2 | 8/2013 | Windauer | |
| 8,806,798 | B2 | 8/2014 | Crispin | |
| 9,170,068 | B2 | 10/2015 | Crispin | |
| 9,182,773 | B2 | 11/2015 | Campean | |
| 9,188,408 | B2 | 11/2015 | Huynh | |
| 9,665,120 | B2 | 5/2017 | Windauer | |
| 11,248,876 | B2 | 2/2022 | Davis | |
| 2003/0140545 | A1 * | 7/2003 | Huber | F41G 1/38 42/122 |

(Continued)

*Primary Examiner* — Mohammed A Hasan
*Assistant Examiner* — Rahman Abdur
(74) *Attorney, Agent, or Firm* — Schwabe, Williamson & Wyatt, P.C.

(57) ABSTRACT

Rifle scopes with a locking feature including a body having an internal movable optical adjustor adapted to shift an image generated by the riflescope, a knob connected to the body for rotation about a knob axis and operably connected to the optical adjustor to position the optical adjustor based on a rotational position of the knob, an indicator skirt rotatably engaged to the body and threadedly engaged to the knob, the indicator skirt being operable to move axially with respect to the knob such that the axial position of the indicator skirt is based on the rotational position of the knob, and the knob including a knob stop surface and the indicator skirt including a skirt stop surface, wherein the knob stop surface and the skirt stop surface are configured to positively contact each other to establish a limit of rotational travel of the knob.

20 Claims, 9 Drawing Sheets

(56) References Cited

U.S. PATENT DOCUMENTS

| | | | | |
|---|---|---|---|---|
| 2007/0240356 | A1* | 10/2007 | Klepp | G02B 23/00 42/122 |
| 2013/0167425 | A1 | 7/2013 | Crispin | |
| 2014/0223793 | A1* | 8/2014 | Peterson | F41C 23/14 42/71.01 |
| 2016/0123704 | A1 | 5/2016 | Crispin | |

* cited by examiner

FIREARM OPTIC WITH LOCKING FEATURE

CROSS-REFERENCE TO RELATED APPLICATION

This application is a Continuation of U.S. patent application Ser. No. 16/170,623 filed on Oct. 25, 2018, entitled "RIFLE SCOPE WITH ZERO LOCK," which claims the benefit of U.S. Provisional Patent Application No. 62/577,767 filed on Oct. 27, 2017, entitled "ZERO LOCK IMPROVEMENT," which are hereby incorporated by reference in their entirety for all that is taught and disclosed therein.

FIELD OF THE INVENTION

The present invention relates to riflescopes, and more particularly to a rifle scope with a turret having a locking feature that releasably secures the turret in the zero point position or a stop feature that stops the dial at the zero position. The turret also includes a revolution indicator that displays the revolution currently in use.

BACKGROUND OF THE INVENTION

Sighting devices such as rifle scopes have long been used in conjunction with weapons and firearms, such as rifles, handguns, and crossbows, to allow a shooter to accurately aim at a selected target. Because bullet and arrow trajectory, wind conditions, and distance to the target can vary depending upon shooting conditions, quality sighting devices typically provide compensation for variations in these conditions by allowing a shooter to make incremental adjustments to the optical characteristics or the aiming of the sighting device relative to the weapon surface on which it is mounted. These adjustments are known as elevation and windage adjustments, and are typically accomplished by lateral movement of an adjusting member, such as a reticle located within the riflescope.

The shooter typically makes such adjustments using rotatable turrets to actuate the adjustable member of the sighting device. Rotatable turrets may also be used to adjust other features of riflescopes, binoculars, spotting scopes, or other suitable optical devices, such as parallax, focus, illumination brightness, or other suitable features.

A rifle scope has a zero point established by changing the angular position of the adjustable member of the sighting device relative to the rifle barrel until a bullet impacts a target at a specified distance at a point corresponding to the reticle. When a target is farther away than the specified distance used to establish the zero point, the elevation turret is adjusted to compensate for the additional bullet drop. In order to accommodate significantly greater distances than the zero point distance, the elevation turret typically permits multiple rotations to increase the range of adjustment. However, this creates the potential for the shooter to lose track of the zero point by one or more rotations both when rotating towards the zero point and when rotating away from the zero point even when the elevation turret's indicia are visible. Furthermore, the shooter may not be able to see the elevation turret's indicia when lighting conditions are poor.

Various automatically locking devices with rotatable adjustment knobs are known. However, these have various disadvantages including complexity and excessive manufacturing costs. Some also require continuous squeezing to keep the rotatable adjustment knob unlocked, which make it more difficult to accomplish multiple fine rotation adjustments during an aiming operation.

Most prior art rifle scopes have no revolution indicator, but allow multiple turns of a rotatable turret, which makes it easy for a shooter to get "lost" and lose track of how many turns have been made. Some rifle scopes have a button that retracts on the second revolution and an indicator that pops up on the third revolution, but those features require the shooter to remember what revolution each of those features is associated with. Some scopes have a dial that moves up and down, and there is a fixed sleeve inside or outside of the dial that helps indicate the revolution the rifle scope is currently at, but in most cases the revolution indicator either cannot be reset or is susceptible to getting moved and losing its revolution setting when hit on the top of the dial. In addition, since the movement of the dial on those scopes is directly proportionate to the pitch of the adjustment threads, the dial only moves a very small vertical amount each turn, making those marks very small and close together, which results in difficulty reading them.

U.S. Pat. No. 6,691,447 to Otteman discloses a revolution counter that uses a single start thread and a stop that bottoms out and wedges at the zero point. This design has the disadvantage of not providing a precise, positive stop point. Furthermore, the wedging resistance point is subject to change with repeated use as a result of wear.

Therefore, a need exists for a new and improved rifle scope with a locking feature that releasably secures the turret in the zero point position and displays the revolution currently in use. In this regard, the various embodiments of the present invention substantially fulfill at least some of these needs. In this respect, the rifle scope with the locking feature according to the present invention substantially departs from the conventional concepts and designs of the prior art, and in doing so provides an apparatus primarily developed for the purpose of releasably securing the turret in the zero point position and displaying the revolution currently in use.

SUMMARY OF THE INVENTION

The present invention provides an improved rifle scope with a locking feature, and overcomes the above-mentioned disadvantages and drawbacks of the prior art. As such, the general purpose of the present invention, which will be described subsequently in greater detail, is to provide an improved rifle scope with the locking feature that has all the advantages of the prior art mentioned above.

To attain this, the preferred embodiment of the present invention essentially comprises a body having an internal movable optical adjustor adapted to shift an image generated by the riflescope, a knob connected to the body for rotation about a knob axis and operably connected to the optical adjustor to position the optical adjustor based on a rotational position of the knob, an indicator skirt rotatably engaged to the body and threadedly engaged to the knob, the indicator skirt being operable to move axially with respect to the knob such that the axial position of the indicator skirt is based on the rotational position of the knob, and the knob including a knob stop surface and the indicator skirt including a skirt stop surface, wherein the knob stop surface and the skirt stop surface are configured to positively contact each other to establish a limit of rotational travel of the knob. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

Description of the Current Embodiment

Figure 1:
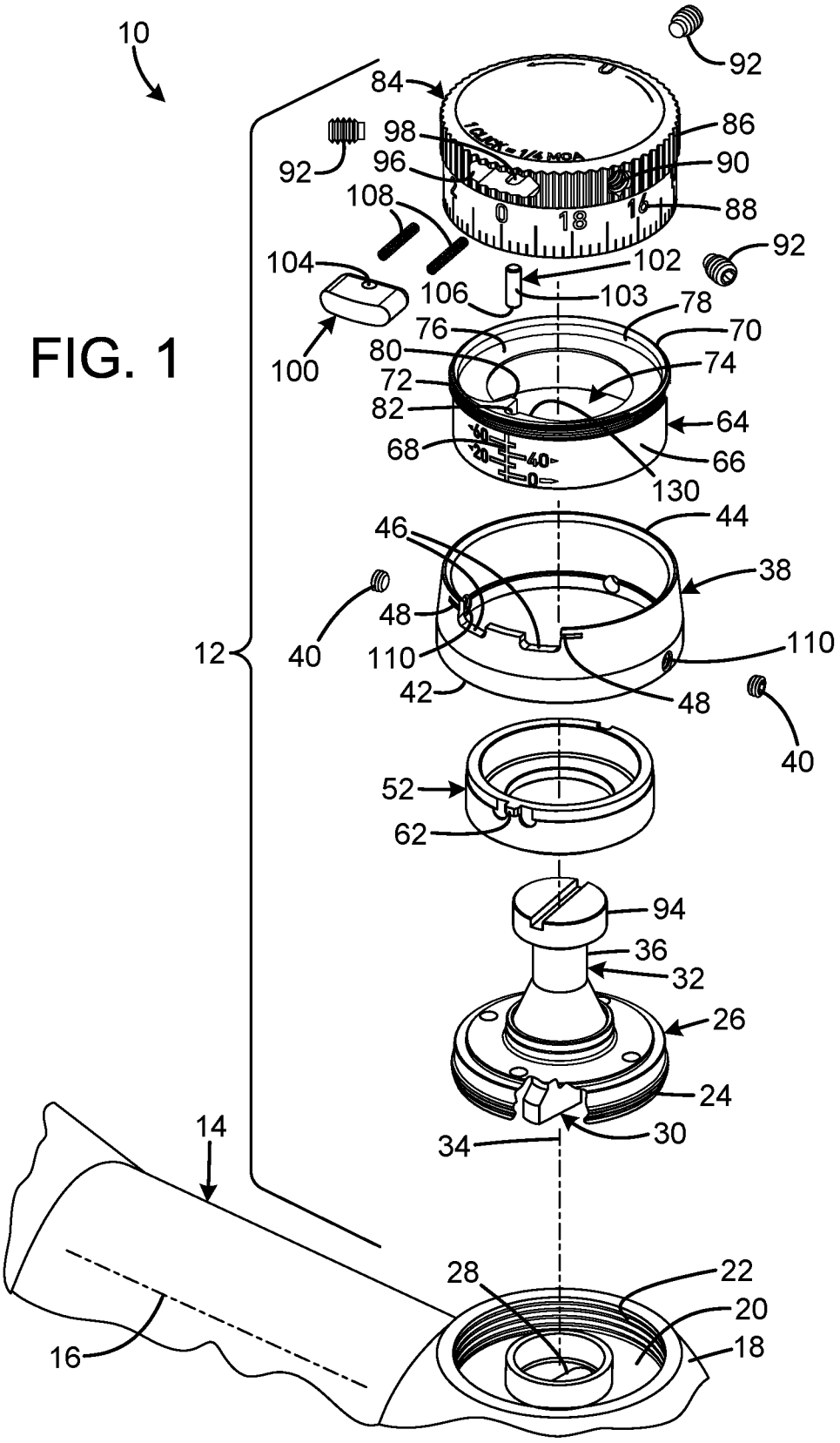
FIG. 1 is an exploded view of the current embodiment of the rifle scope with a locking device constructed in accordance with the principles of the present invention.

A current embodiment of the rifle scope with the locking device of the present invention is shown and generally designated by the reference numeral 10.

FIGS. 1-4 illustrate the improved rifle scope with zero lock 10 of the present invention. More particularly, the rifle scope with zero lock has an elevation turret 12 mounted to a main tube 14 of the rifle scope. Within the main tube, at least one adjustable element, such as a reticle, lens assembly, or other optical or electrical elements (not shown), may be movably mounted in a substantially perpendicular orientation relative to a longitudinal tube axis 16. The main tube further includes a seat 18, which has a bore 20 sized to receive the elevation turret. The bore includes threads 22 formed on an interior wall or shoulder that mate with corresponding exterior threads 24 on a turret flange 26 to releasably secure the elevation turret to the main tube when the elevation turret is installed.

The bore 20 defines slot 28 that is sized to receive one end of a plunger 30 that protrudes below the turret flange 26. The plunger is connected to an elevation adjustment spindle 32 by a threaded end 120 threadedly received within a threaded bore 122 in the elevation adjustment spindle. The plunger 30 extends into main tube 14 and is constrained from rotating about vertical axis/knob axis 34 by the slot so that rotation of the elevation adjustment spindle is translated into linear motion of the plunger along the vertical axis, thereby adjusting a position of the adjustable element within the main tube.

The elevation adjustment spindle 32 includes a lower base portion (not visible) that receives the turret flange 26 and an upper neck portion 36, which preferably is smaller in diameter than the lower base portion. The turret flange surrounds the lower base portion of the elevation adjustment spindle and retains the elevation adjustment spindle against seat 18 of main tube 14. The exterior threads 24 on the turret flange are sized to mesh with threads 22 in the bore. Thus, the elevation adjustment spindle is captured against the main tube and allowed to rotate about vertical axis 34, but is constrained from traveling along the vertical axis by the turret flange. An outer sleeve 38 surrounds the elevation adjustment spindle and the turret flange, but leaves the threads 24 on the turret flange uncovered. Two set screws 40 received in threaded bores 110 threadedly secure the bottom 42 of the outer sleeve against the turret flange immediately above threads 24. The top 44 of the outer sleeve defines windows 46 and includes indicia 48 on either side of the windows.

The turret flange 26 has an interior surface 54 that faces and surrounds the elevation adjustment spindle 32 to provide tactile and/or audible feedback to the shooter when the elevation turret 12 is rotated. The interior surface of the turret flange includes regularly spaced apart features (shown in FIGS. 3 & 4), which preferably include splines or a series of evenly spaced vertical grooves or ridges. Other engagement features may include a series of detents, indentations, apertures, or other suitable features. A click pin 56 with a ramped surface 58 is configured to engage the regularly spaced apart features of the interior surface. The click pin is housed within a bore 60 in the elevation adjustment spindle that has an open end facing the interior surface. A spring or other biasing element (not shown), urges the click pin to extend outwardly from within the bore and engage the interior surface. In operation, rotational movement of the elevation turret about vertical axis 34 causes the click pin to move out of contact with one groove and into a neighboring groove, thereby producing a click that is either audible, tactile, or both. Each click may coincide with an adjustment amount to alert the user about the extent of an adjustment being made. The click pin continues clicking as long as the elevation turret is rotated.

A revolution indicator/indicator skirt 64 surrounds the elevation adjustment spindle 32 and at least a portion of the index ring 52. The revolution indicator is surrounded by the outer sleeve 38, except for a small portion of the revolution indicator that is exposed by the windows 46 in the top 44 of the outer sleeve. The exterior 66 of the revolution indicator has indicia 68, which denote 0, 20, 40, and 60 Minutes Of Angle (MOA) in the current embodiment. The top 70 of the revolution indicator has exterior threads 72. The top of the interior 74 of the revolution indicator includes a guideway 76 having a curved clearance surface 78 extending around and facing vertical axis 34. The guideway includes a ramp 130, a notch/skirt stop surface 82, and an overtravel stop 80. The ramp, notch, and overtravel stop are located above indicia 68, and the notch extends in a radial direction relative to the vertical axis.

A dial/knob 84 is mounted over the revolution indicator 64 and the elevation adjustment spindle 32 for rotation about vertical axis/knob axis 34 when elevation turret 12 is installed on the main tube 14. The dial includes a cylindrical gripping surface 86 that may be notched, fluted, knurled, or otherwise textured to provide a surface for the user to grip when manually rotating the dial. The dial has a fine scale composed of parallel longitudinal indicia 88 spaced apart around the circumference of the dial to facilitate fine adjustments. The dial includes three threaded bores 90 equal distantly spaced around the circumference of the dial and sized to receive threaded set screws 92. It should be appreciated that any number of bores, with a corresponding number of set screws, may be provided on the dial. The set screws rigidly couple the dial to the upper portion 94 of the elevation adjustment spindle so the dial and elevation adjustment spindle rotate together as a unit. Thus, the dial is operably connected to the optical adjustor to position the optical adjustor based on a rotational position of the dial. A tool, such as a hex key (not shown), can be used to tighten the set screws such that the set screws bear against the upper portion of the spindle. Similarly, the tool can be used to loosen the set screws so that the dial can be rotated relative to the elevation adjustment spindle about the vertical axis or be removed and replaced with a different dial if desired. In other embodiments (not shown), the dial is coupled or releasably coupled to the elevation adjustment spindle in a manner other than by set screws.

An index ring 52 includes an exterior tooth 62 that engages with a vertical slot/channel 124 (shown in FIGS. 3 & 4) on an interior surface of the revolution indicator 64. The exterior tooth is constrained for movement within the vertical slot, and the vertical slot is parallel to the vertical axis 34 to prevent rotation of the revolution indicator about the vertical axis when the dial 84 is rotated. Because the revolution indicator is constrained from rotating about the vertical axis, rotation of the dial is translated into linear motion of the revolution indicator along the vertical axis, thereby changing the portion of indicia 68 that are viewable through windows 46 of the outer sleeve 38. Thus, the axial position of the revolution indicator is based on the rotational position of the dial.

Grip surface 86 of dial 84 defines an aperture 96 with a slot 98 that is sized to closely receive a locking push button 100 having a locking pin/knob stop surface 102 received in an aperture 104. The locking push button is operably associated with the locking pin and is manually depressible to urge the locking pin out of a locked position and thereby allow the dial to be manually rotated about vertical axis 34 away from the locked position. The locking pin has a cylindrical lower portion 106 that is slidably received by slot 98 and guideway 76. The locking pin can be considered to be a post extending on a post axis 126 parallel to the vertical axis. The locking pin has a flat end surface 128. The locking pin is configured to travel along the guideway, riding against the end of slot 98 and not touching the curved clearance surface 78 in response to rotation of the dial. The locking push button includes a pair of openings (not visible) sized to interact with a pair of springs 108 or other biasing elements. The springs bias the locking push button and the locking pin in a radial direction relative to the dial so as to urge movement of the locking pin when the dial is rotated.

When elevation turret 12 is in a locked position, locking pin 102 has a knob stop surface 103 that is aligned with and seated in notch/skirt stop surface 82, thereby constraining dial 84 and preventing inadvertent rotation of the dial relative to the main tube 14. Thus, the knob stop surface and the skirt stop surface are configured to positively contact each other to establish a limit of rotational travel of the dial. For the purposes of the specification, "positively" means where direct contact is made by two surfaces that abut each other without a substantial wedging effect. Examples of "non-positive" are any screw threads or multi-start screw threads with a helical angle of less than 45°, but a substantially sloped surface, such as a 45° angle, would be considered "positive" because there is substantially no wedging effect. The preferred embodiment with surfaces that are perpendicular to their direction of approach are an ideal example of "positive." Even though the locking pin and notch are curved surfaces rather than flat, the line of contact at some point is perpendicular. Another way of describing positive contact is when the surfaces approach each other with more of a face-to-face approach than a sliding approach. Furthermore, the knob stop surface and skirt stop surface are parallel to the vertical axis/knob axis 34 such that they contact each other in an abutting manner without a wedging effect. The notch serves as a channel receiving the locking pin at the limit of rotational travel and has a closed end providing the skirt stop surface. The channel is concentric to the vertical axis. In this position, springs 108 urge the cylindrical lower portion 106 of locking pin 102 into notch 82. To unlock the elevation turret, locking push button 100 is depressed inwardly toward the vertical axis to urge the locking pin out of the notch. From this position, dial 84 can be manually rotated about the vertical axis away from the locked position. Thus, the knob stop surface is movable radially with respect to the vertical axis between a locked position in which the rotation of the dial is prevented and an unlocked position in which rotation of the dial is enabled. Furthermore, the knob stop surface is connected to a movable button (the locking push button) protruding radially from the dial. As the dial is rotated (i.e., as the user is making a desired adjustment), the locking button can be released, and the locking pin rides away from the notch and along the ramp and curved clearance surfaces. The ramp surface is a flat surface parallel to the vertical axis that defines a recess in the form of notch 82. The ramp 130 is shaped to help create and define the notch 82. As the dial rotates, the revolution indicator 64 descends within the dial and the outer sleeve 38. Once the dial has completed a rotation around the vertical axis, the revolution indicator has descended sufficiently so the locking pin does not engage with overtravel stop 80, the ramp 130, or the notch on the second and subsequent rotations. Thus, the dial can continue to turn for multiple rotations without locking. As the dial completes a rotation around the vertical axis, the portion of indices 68 viewable through the windows 46 and aligned with indicia 48 changes, which enables the user to readily determine how many rotations of the dial about the vertical axis have been completed. The user can continue turning the dial until the revolution counter 64 bottoms out against the flange 26 somewhere between 60 and 80 MOA of adjustment, or the rifle scope itself runs out of internal elevation travel, whichever comes first. At that point, further rotation of the dial in this direction is prevented. The dial can still be rotated in an opposite direction for further fine adjustment and/or to return the dial to its zero point/home position where the dial automatically locks by engagement of the cylindrical lower portion 106 of locking pin 102 in notch 82. The overtravel stop 80 is a surface that keeps the dial from rotating past 0 even when the locking push button is pressed. The curved surface to the left of the overtravel stop has that shape because of the tool geometry used to cut guideway 76. During the first rotation of the dial, the locking pin is not prevented from moving further out radially by curved clearance surface 78; in most tolerance conditions, the locking pin never touches the curved clearance surface. Instead, the locking pin is prevented from moving out radially by the end of the slot 98 so the locking pin does not drag on the curved clearance surface during the first rotation (which would result in an undesirable tactile feel). The locking pin only drags on ramp 130 to compress the springs and move the locking pin radially inward, allowing the locking pin to then return outward into the notch created by the ramp. The revolution indicator, locking push button, and locking pin are preferably constructed of or coated with a rigid, durable, and wear-resistant material, such as nylon, PTFE polymers (e.g., Teflon®), steel, aluminum, or other suitable material, to withstand wear due to friction as the locking pin slides along or within the revolution indicator. In other embodiments, the locking push button may be manufactured from one material, and the locking pin may be manufactured from a different material. For instance, since the locking push button may not experience as much wear from friction as compared to the locking pin, the locking push button may be constructed from anodized aluminum or other material to provide a balance of component weight, wear-resistance, and strength. On the other hand, since the sliding action of the locking pin on or along the revolution indicator will wear the locking pin over time, the locking pin may be manufactured from or coated with a different material, such as stainless steel, for strength, wear-resistance, and corrosion-resistance.

Figure 2:
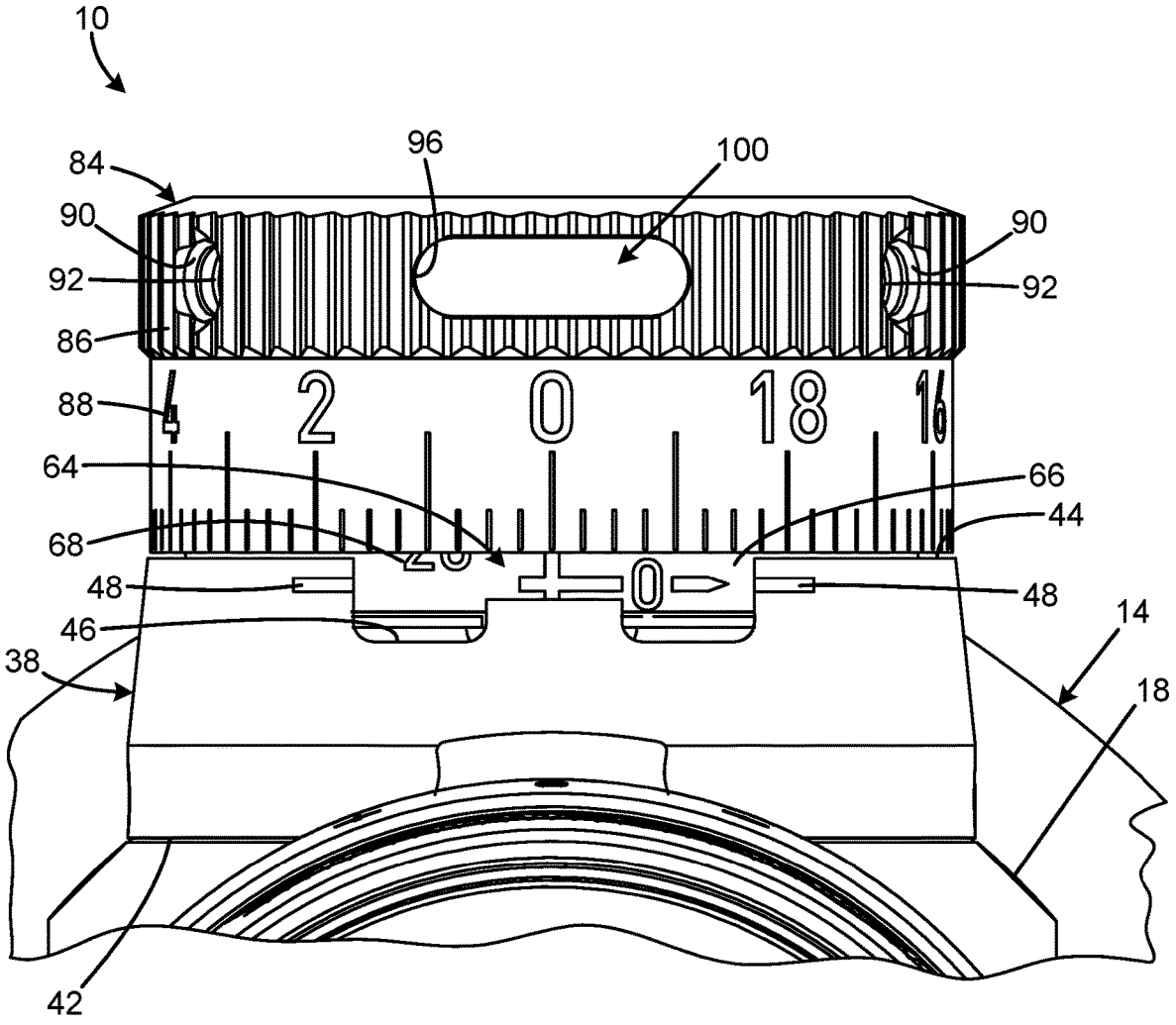
FIG. 2 is a front view of the current embodiment of the rifle scope with the locking device of FIG. 1 in the zero point locked position.
Figure 3:
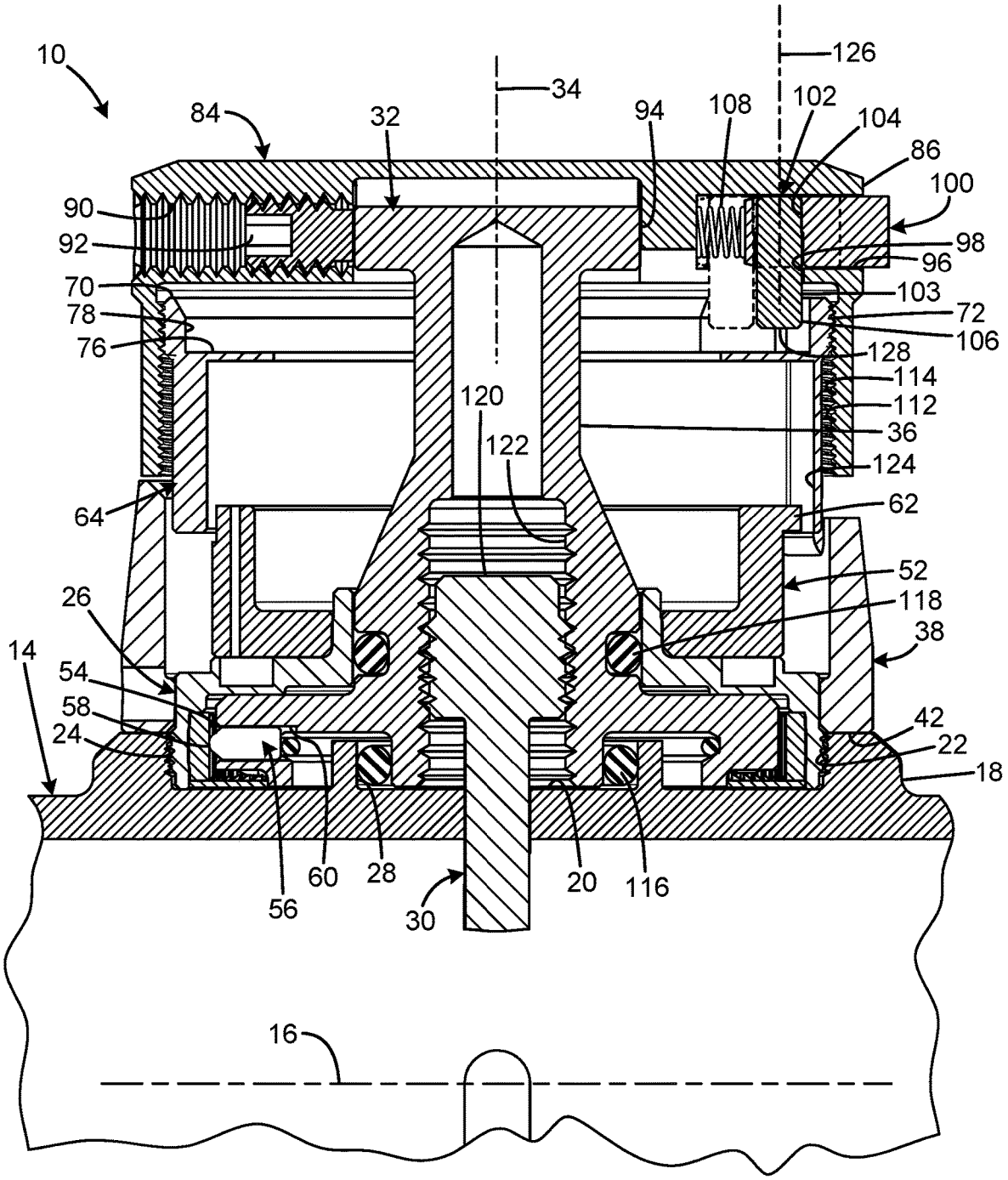
FIG. 3 is a side sectional view of the current embodiment of the rifle scope with the locking device of FIG. 1 in the zero point locked position with dashed lines showing the zero lock push button in the unlocked position.
Figure 4:
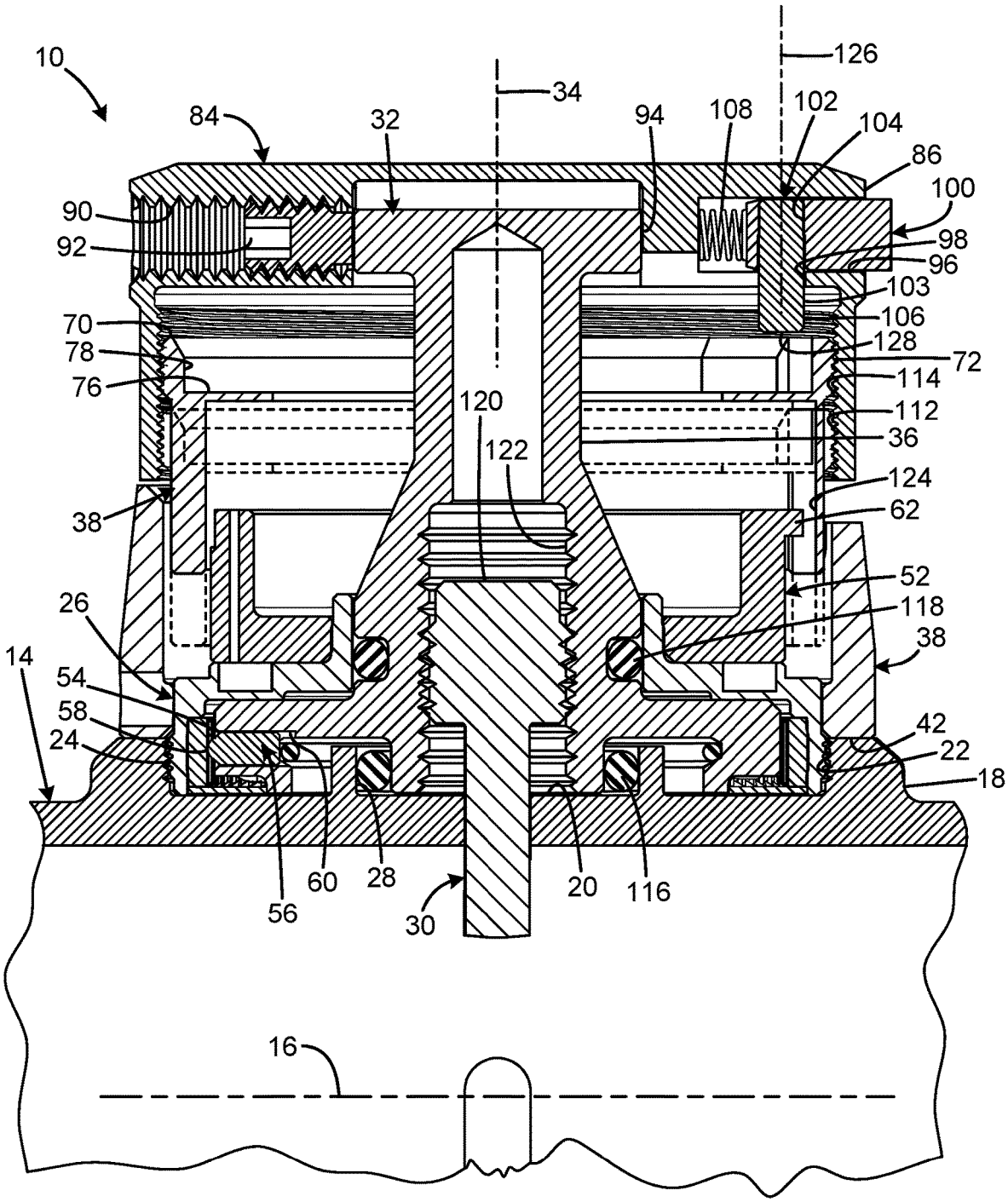
FIG. 4 is a side sectional view of the current embodiment of the rifle scope with the locking device of FIG. 1 after one rotation from the position shown in FIG. 3 with dashed lines showing the position of the revolution indicator after three rotations.
Figure 5:
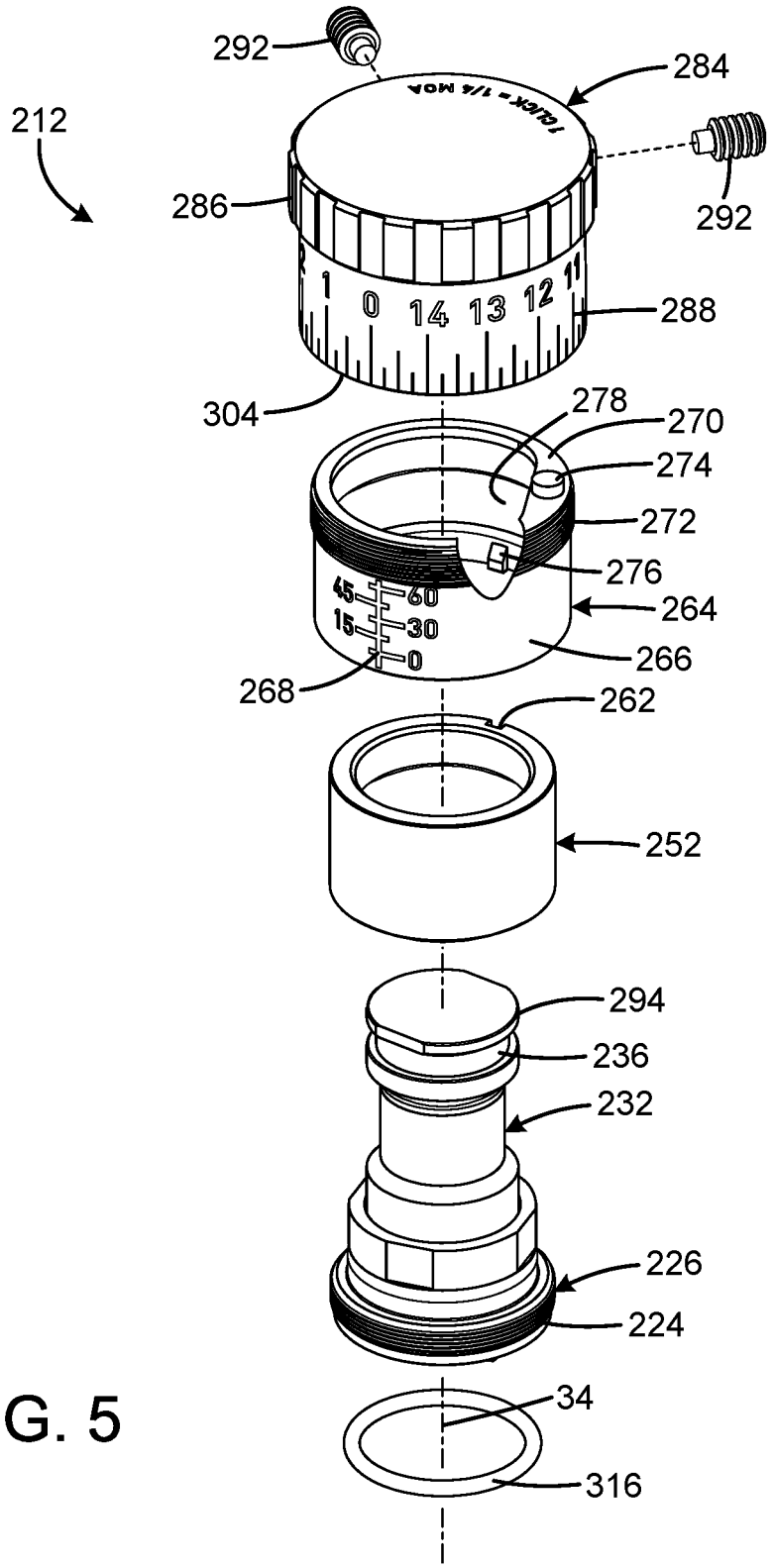
FIG. 5 is an exploded view of the current embodiment of a rifle scope with zero stop constructed in accordance with the principles of the present invention.

FIGS. 2-4 illustrate how the indicia 68 exposed by windows 46 indicate whether dial 84 is in the zero point locked position and also for indicating the number of rotations of the dial. Simply by considering the relative positions of indicia 68 and indicia 48, the user can quickly determine the state of the dial (i.e., whether it is locked and/or the number of rotations about vertical axis 34). In an example operation, when the dial is in a locked position (during which locking pin 102 is received within notch 82), locking push button 100 is in a first position, such as illustrated in FIG. 3 in solid lines. In this first position, the locking push button extends outwardly from grip surface 86. Indicia 88 show the indicium for 0 MOA centered over indicia 68, and indicia 68 have the indicium for 0 MOA visible through right hand window 46 and aligned with right hand indicium 48.

To unlock dial 84, the user may depress locking push button 100 inwardly toward the vertical axis 34 until the locking push button is substantially flush in relation to grip surface 86 (the position shown in dashed lines in FIG. 3). Depression of the locking push button contracts springs 108 and urges cylindrical lower portion 106 of locking pin 102 out of alignment with notch 82 and onto ramp surface 130 as previously described. The dial is unlocked and can be manually rotated in a single direction about vertical axis 34. The overtravel stop 80 obstructs the cylindrical lower portion of the locking pin to prevent the dial from being manually rotated in the opposite direction. As the dial is rotated, the locking button can be released and the pin slides on the ramp. The locking push button and locking pin return to the locked position under the influence of the springs, and the locking pin is stopped by the end of slot 98 in the dial. The dial remains unlocked because the locking pin is in or above guideway 76 (i.e., throughout all rotations of adjustment until the cylindrical lower portion of the locking pin is engaged with the ramp in the process of being returned to the notch). As the dial rotates, the revolution indicator 64 descends to expose a different portion of indicia 68 through the windows 46 denoting increasing amounts of adjustment until further rotation of the dial is prevented as described previously when 60 to 80 MOA of adjustment is reached. The cross-sectional view in FIG. 4 illustrates the position of the locking pin after the dial has been rotated once about the vertical axis.

Reversing rotation of the dial 84 at any point causes the same functions to be performed in reverse. For example, when the dial is rotated in the reverse direction, the revolution indicator 64 ascends within the dial and outer sleeve 38 to expose a different portion of indicia 68 through the windows 46 denoting decreasing amounts of adjustment. As the dial is turned back into the zero point locked position, cylindrical lower portion 106 of locking pin 102 is forced radially inward by ramp 130 until the locking pin is urged into notch 82 by springs 108 acting on locking push button 100 to automatically lock the dial. The locking push button is also returned to the locked position where the locking push button extends outwardly from gripping surface 86.

The elevation turret 12 of the current invention allows for more available rotations of the dial 84 than traditional elevation turrets having a zero point lock capability and provides a zero point lock capability at a reduced cost of manufacture compared to traditional approaches. A critical difference of the elevation turret of the current invention is the threading of the revolution indicator 64 to the dial with multi-start threads 72 on the revolution indicator and multi-start threads 112 on the interior 114 of the dial (shown in FIGS. 3 & 4). The multi-start threads (four start threads in the current embodiment) enable the elevation turret to be built without timing threads or additional adjustable components, which helps reduce cost. In conventional elevation turrets having a zero point lock capability, the height between the dial/pin and the locking feature/notch is fixed. The conventional locking mechanism has a path that wraps around and curls inside itself allowing two or three revolutions. However, more than two or three revolutions would make the conventional dial prohibitively large in diameter. By making the locking feature/notch move away from the locking pin in the current invention during the first revolution, multiple additional revolutions are enabled.

By using four start threads 72, 112, the current invention allows for more engagement of cylindrical lower portion 106 of locking pin 102 with notch 82 than a similar one start thread would (one start maximum engagement for 48 pitch threads would be $\frac{1}{48}$=0.021", whereas four start maximum engagement for 48 pitch threads would be $\frac{1}{48}$*4=0.083"). Thus, the revolution indicator/indicator skirt 64 is threadedly engaged to the dial/knob 84 by threads having a selected pitch providing a selected axial offset of the revolution indicator with respect to the dial from one rotation of the dial.

Furthermore, the revolution indicator has indicia 68 that include rotation indicators spaced apart by a distance equal to the selected axial offset. The indicia are a plurality of parallel lines. The use of four start threads also minimizes the amount of variation in that engagement by starting on the correct thread. This can be accomplished by keeping a tight enough tolerance on the height from the notch to where the threads start, in combination with alignment features that indicate which orientation the dial and notch need to be held for the correct thread start to catch and engage when assembling the revolution indicator to the dial. If assembled correctly, the height of the total dial and revolution indicator assembly will be within a band that is the width of 1 thread (48 pitch thread results in a band 0.021" wide) plus the tolerance of the revolution indicator and the dial. Correct assembly can be checked with calipers or a gauge.

When installed with one start threads, the engagement of the cylindrical lower portion 106 of the locking pin 102 with notch 82 would vary from 0" to 0.021", whereas correctly installed four start threads will allow the use of a 0.021" range of the 0.083" total engagement available. For example, once the tolerance stack is considered, the ideal engagement may be 0.054" to 0.075" to make sure there is always good engagement of the locking pin with the notch and the dial and revolution indicator assembly never bottoms out before the locking pin engages with the notch. This would not be possible without timed threads using a one start thread and, even if timed threads were used, it would be significantly more susceptible to wear and damage because of the extremely limited 0.021" maximum engagement of the locking pin with the notch, which would have to be limited even further due to tolerance considerations.

In some embodiments, the locking pin 102 could be threaded into the locking push button 100 so as to be adjustable to maximize engagement with the locking notch 82 when using single start threads and/or compensate for the variation cause by untimed threads.

In some embodiments, rifle scope with a locking device 10 may include sealing devices and other features to minimize entry of foreign materials, such as dust, dirt, or other contaminants, to help prevent rust, wear, or other damage to the components of the rifle scope with the locking device. The seals may be hermetic seals, and the interior of the main tube 14 may be filled with a dry gas, such as nitrogen or argon, to help prevent fogging that may otherwise be caused by condensation of moisture vapor on surfaces of lenses and other optical elements within the main body. For example, in some embodiments, elevation turret 12 may include a pair of contaminant seals 116, 118 sandwiched between the turret flange 26 and the elevation adjustment spindle 32 to seal any openings or gaps between the two components and the bore 20. The contaminant seals are preferably O-rings formed of rubber or another elastomeric material, but may be formed by any other suitable sealing material, such as plastic, nylon, or PTFE polymers (e.g., Teflon®).

FIGS. 5 & 7-9 illustrate a current embodiment of the improved rifle scope with zero stop 200 of the present invention. More particularly, the rifle scope with zero stop has an elevation turret 212 mounted to a main tube 14 of the rifle scope. Within the main tube, at least one adjustable element, such as a reticle, lens assembly, or other optical or electrical elements (not shown), may be movably mounted in a substantially perpendicular orientation relative to a longitudinal tube axis 16. The main tube further includes a seat 18, which has a bore 20 sized to receive the elevation turret. The bore includes threads 22 formed on an interior wall or shoulder that mate with corresponding exterior threads 224 on a turret flange 226 to releasably secure the elevation turret to the main tube when the elevation turret is installed.

The bore 20 defines an aperture 28 that is sized to receive one end of a plunger 230 that protrudes below the turret flange 226. The plunger is connected to an elevation adjustment spindle 232 by a threaded end 320 threadedly received within a threaded bore 322 in the elevation adjustment spindle. The plunger 230 extends into main tube 14 and is constrained from rotating about vertical axis 34 so that rotation of the elevation adjustment spindle is translated into linear motion of the plunger along the vertical axis, thereby adjusting a position of the adjustable element within the main tube.

The elevation adjustment spindle 232 includes a lower base portion (not visible) that receives the turret flange 226 and an upper neck portion 236, which preferably is smaller in diameter than the lower base portion. The turret flange surrounds the lower base portion of the elevation adjustment spindle and retains the elevation adjustment spindle against seat 18 of main tube 14. The exterior threads 224 on the turret flange are sized to mesh with threads 22 in the bore.

Thus, the elevation adjustment spindle is captured against the main tube and allowed to rotate about vertical axis 34, but is constrained from traveling along the vertical axis by the turret flange. In the current embodiment, an 0-ring 316 is sandwiched between lower base portion of the elevation adjustment spindle and the base of the seat. An index ring 252 surrounds the elevation adjustment spindle and the turret flange, but leaves the threads 224 on the turret flange uncovered. The index ring has a rear vertical slot 262.

A revolution indicator 264 surrounds the elevation adjustment spindle 232 and at least a portion of the index ring 252. The exterior 266 of the revolution indicator has indicia 268, which denote 0, 15, 30, 45, and 60 Minutes Of Angle (MOA) in the current embodiment. The top 270 of the revolution indicator has exterior threads 272. A zero stop boss 274 protrudes upwards from the top of the revolution indicator. A tooth 276 protrudes inwardly towards the vertical axis 34 from the interior 278 of the revolution indicator.

A dial 284 is mounted over the revolution indicator 264 and the elevation adjustment spindle 232 for rotation about vertical axis 34 when elevation turret 212 is installed on the main tube 14. The dial includes a cylindrical gripping surface 286 that may be notched, fluted, knurled, or otherwise textured to provide a surface for the user to grip when manually rotating the dial. The dial has a fine scale composed of parallel longitudinal indicia 288 spaced apart around the circumference of the dial to facilitate fine adjustments. The dial includes two threaded bores (not visible) spaced around the circumference of the dial and sized to receive threaded set screws 292. It should be appreciated that any number of bores, with a corresponding number of set screws, may be provided on the dial. The set screws rigidly couple the dial to the upper neck portion 236 of the elevation adjustment spindle so the dial and elevation adjustment spindle rotate together as a unit. A tool, such as a hex key (not shown), can be used to tighten the set screws such that the set screws bear against the upper neck portion of the spindle. Similarly, the tool can be used to loosen the set screws so that the dial can be rotated relative to the elevation adjustment spindle about the vertical axis or be removed and replaced with a different dial if desired. In other embodiments (not shown), the dial is coupled or releasably coupled to the elevation adjustment spindle in a manner other than by set screws. A flanged portion 294 on the upper neck portion help prevent the dial from lifting upward in a direction along the vertical axis.

The tooth 276 of the revolution indicator 264 engages with rear vertical slot 262 in the index ring 252 to prevent rotation of the revolution indicator about the vertical axis 34 when the dial 284 is rotated. The index ring is prevented from rotating when the dial is rotated by a press fit and/or adhesive between the index ring and the flange 226. Because the revolution indicator is constrained from rotating about the vertical axis, rotation of the dial is translated into linear motion of the revolution indicator along the vertical axis, thereby changing the portion of indicia 268 that is viewable below the dial.

Figure 6:
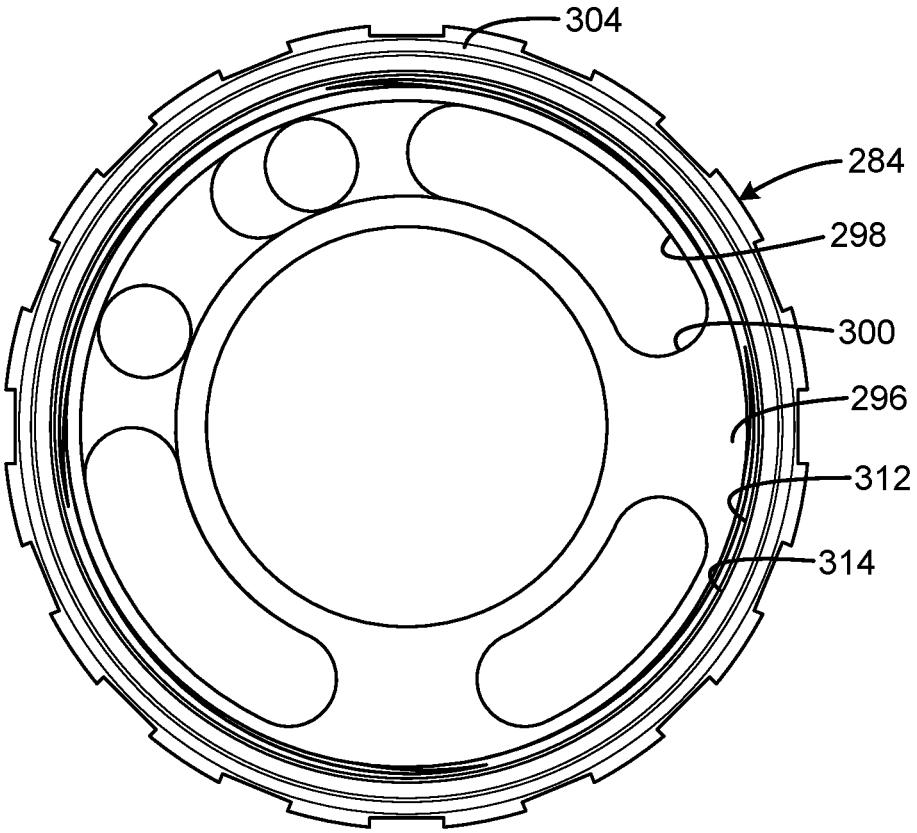
FIG. 6 is a bottom view of the dial of FIG. 5.

Referring now to FIG. 6, the underside 296 of the dial 284 defines a curved slot 298. The slot closely receives the zero stop boss 274 at one end 300 when the dial is positioned at the zero point, thereby constraining the dial and preventing further rotation of the dial about the vertical axis 34 beyond the zero point relative to the main tube 14. From this stopped position, the dial can be manually rotated about the vertical axis away from the zero point position. As the dial is rotated (i.e., as the user is making a desired adjustment), the zero stop boss rides away from the stopped position and along the curved slot. As the dial rotates, the revolution indicator 264 descends within the dial. Once the dial has completed a rotation around the vertical axis, the revolution indicator has descended sufficiently so the zero stop boss does not engage with the end or any other portion of the curved slot on the second and subsequent rotations. Thus, the dial can continue to turn for multiple rotations without stopping. As the dial completes a rotation around the vertical axis, the portion of indices 268 viewable below the dial changes, which enables the user to readily determine how many rotations of the dial about the vertical axis have been completed. The user can continue turning the dial until the revolution counter 264 bottoms out against the flange 26 somewhere between 60 and 75 MOA of adjustment or the scope itself runs out of internal elevation travel, whichever comes first. At that point, further rotation of the dial in this direction is prevented. The dial can still be rotated in an opposite direction for further fine adjustment and/or to return the dial to its zero point/home position where the dial automatically stops by contact between the zero stop boss and the end of the curved slot. The revolution indicator, dial, and zero stop boss are preferably constructed of or coated with a rigid, durable, and wear-resistant material, such as nylon, PTFE polymers (e.g., Teflon®), steel, aluminum, or other suitable material, to withstand wear from the zero stop boss stopping further rotation when hitting the end of the zero stop slot. The zero stop boss never touches the outside edges of the slot 298 in the dial. The zero stop boss only touches the stop face 300 when the adjustment reaches zero to prevent further rotation. This interface is critical because the user may hit the stop quite hard, damaging the zero stop boss if the zero stop boss is not sufficiently durable to withstand that force. In other embodiments, the dial may be manufactured from one material, and the zero stop boss may be manufactured from a different material. For instance, since the dial may not experience as much wear from stopping the rotation due to the amount of material supporting the zero top interface as compared to the zero stop boss, the dial may be constructed from anodized aluminum or other material to provide a balance of component weight, wear-resistance, and strength. On the other hand, since the zero stop boss is smaller and has less strength due to less supporting material, the zero stop boss may be manufactured from or coated with a different material, such as stainless steel, for strength, wear-resistance, and corrosion-resistance.

Figure 7:
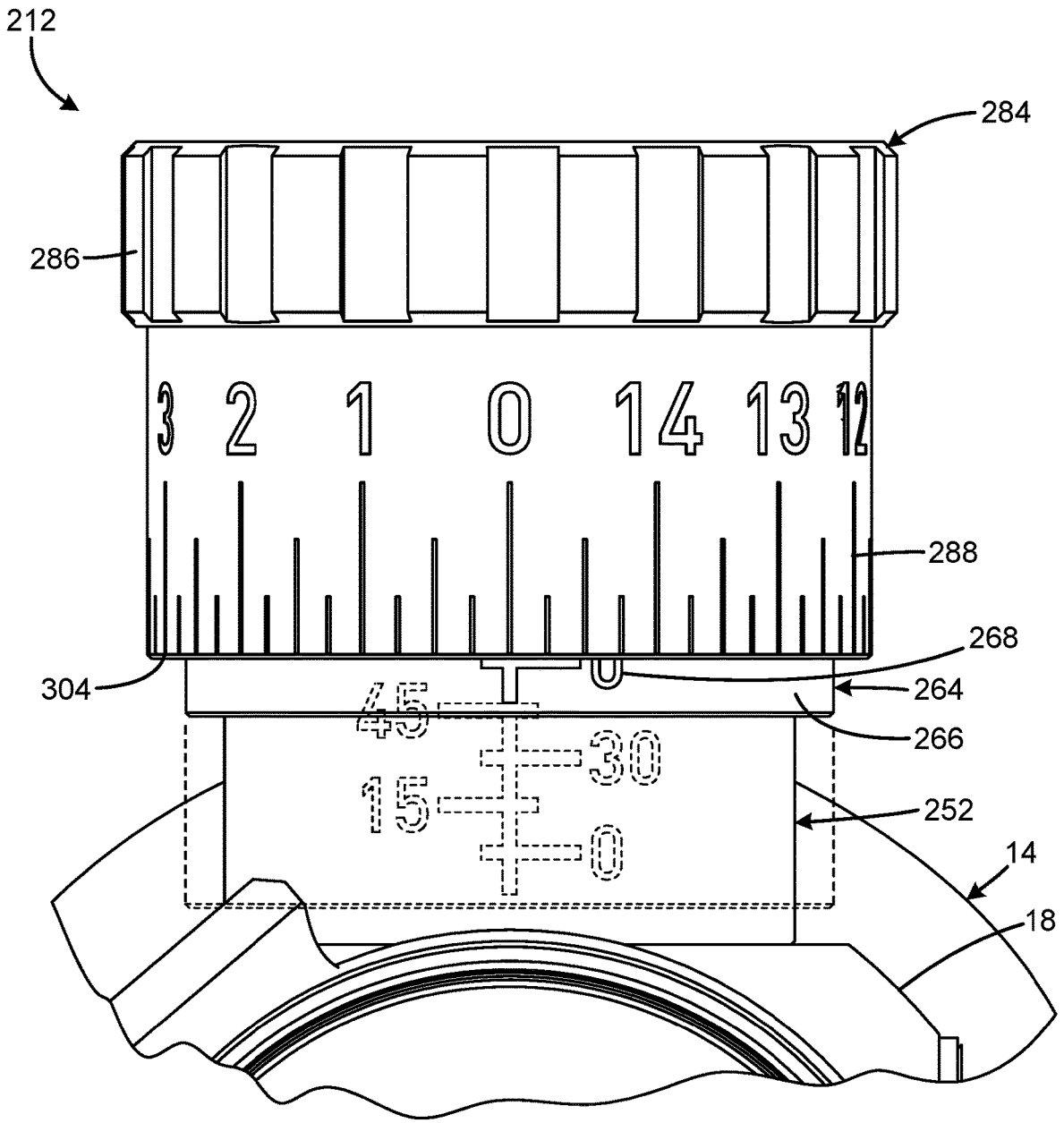
FIG. 7 is a front view of the current embodiment of the rifle scope with zero stop of FIG. 5 in the zero point stopped position with the half of the revolution indicator shown in the position after four rotations.
Figure 8:
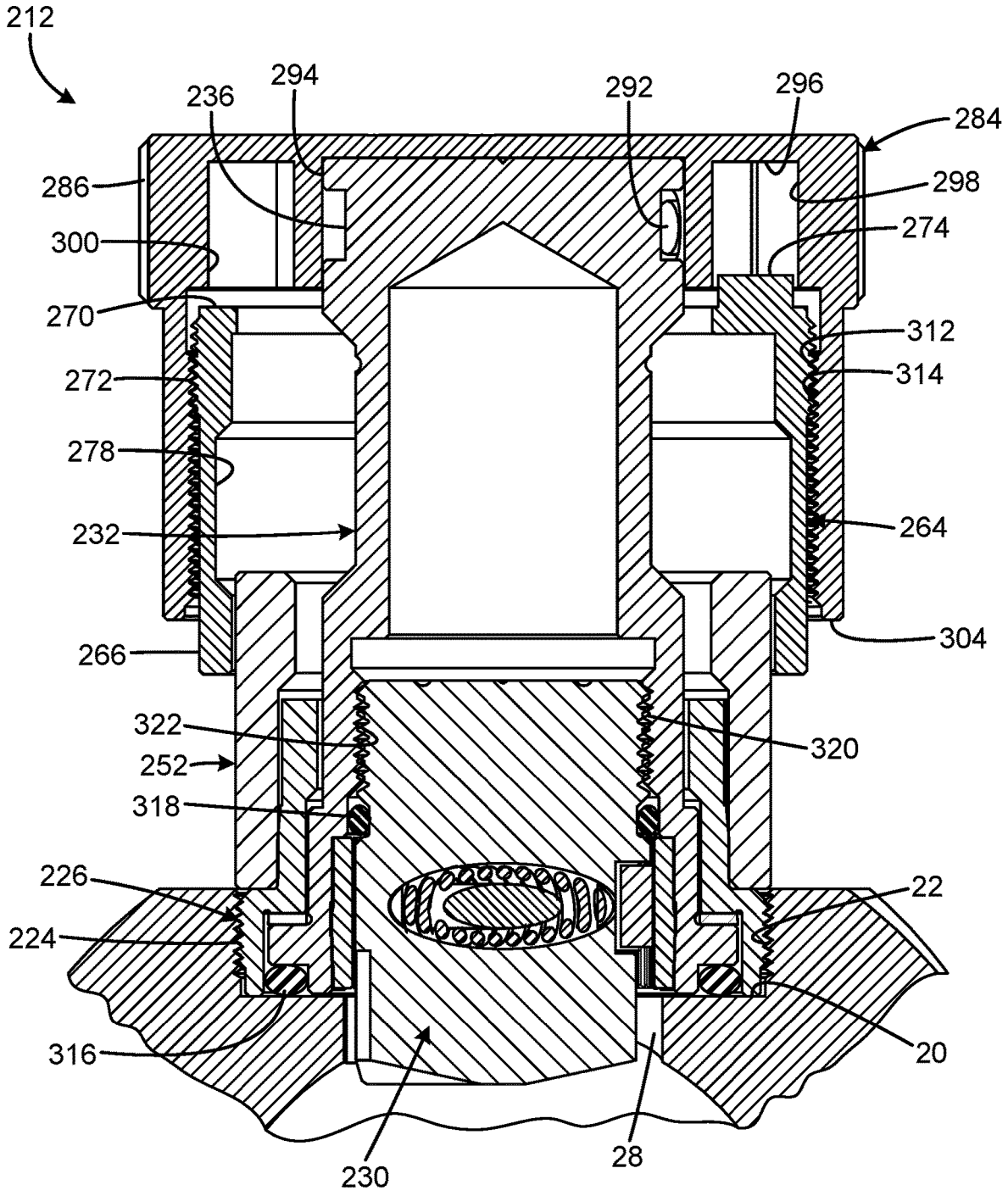
FIG. 8 is a diagonal sectional view of the current embodiment of the rifle scope with zero stop of FIG. 5 in the zero point stopped position.
Figure 9:
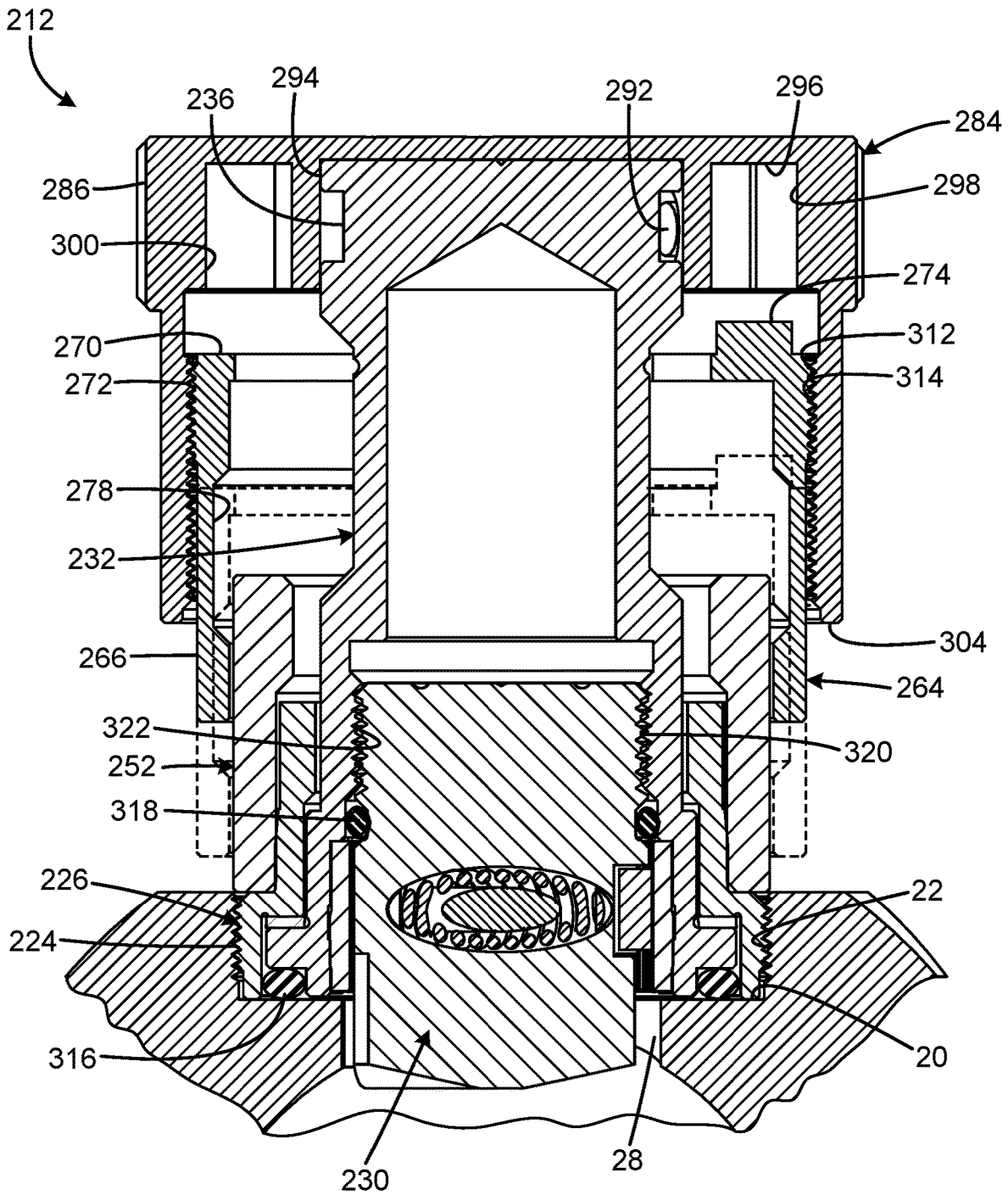
FIG. 9 is a diagonal sectional view of the current embodiment of the rifle scope with zero stop of FIG. 5 after one rotation from the position shown in FIG. 8 with dashed lines showing the position of the revolution indicator after four rotations.

FIGS. 7-9 illustrate how the indicia 268 exposed below dial 284 indicate whether the dial is in the zero point stopped position and also for indicating the number of rotations of the dial. Simply by considering the relative position of indicia 268 and the bottom 304 of the dial, the user can quickly determine the state of the dial (i.e., whether it is stopped and/or the number of rotations about vertical axis 34). In an example operation, when the dial is in a stopped position (during which zero stop boss 274 is received within curved slot 298 and is obstructed by end 300), the revolution indicator 264 is in a first position, such as illustrated in FIG. 7. In this first position, indicia 268 have the indicium for 0 MOA visible.

When dial 284 is in the zero point position, the dial can be manually rotated in a single direction about vertical axis 34. The end 300 of the curved slot 298 obstructs the zero stop boss 274 to prevent the dial from being manually rotated in the opposite direction. As the dial is rotated, the zero stop boss slides in the curved slot. As the dial rotates, the revolution indicator 264 descends to expose a different portion of indicia 268 below the dial denoting increasing amounts of adjustment until further rotation of the dial is prevented as described previously when 60-75 MOA of adjustment is reached. The diagonal cross-sectional view in FIG. 9 illustrates the position of the revolution indicator after the dial has been rotated once about the vertical axis.

Reversing rotation of the dial 284 at any point causes the same functions to be performed in reverse. For example, when the dial is rotated in the reverse direction, the revolution indicator 264 ascends within the dial to expose a different portion of indicia 268 below the dial denoting decreasing amounts of adjustment. As the dial is turned back into the zero point stopped position, the zero stop boss 274 is obstructed by end 300 of the curved slot 298, which prevents further rotation of the dial past the zero point.

The elevation turret 212 of the current invention allows for more available rotations of the dial 284 than traditional elevation turrets having a zero point stop capability, and provides a zero point stop capability at a reduced cost of manufacture compared to traditional approaches. A critical difference of the elevation turret of the current invention is the threading of the revolution indicator 264 to the dial with multi-start threads 272 on the revolution indicator and multi-start threads 312 on the interior 314 of the dial (shown in FIGS. 6-9). The multi-start threads (four start threads in the current embodiment) enable the elevation turret to be built without timing threads, which helps reduce cost. In conventional elevation turrets having a zero point stop capability, the height between the dial/stop and the stopping feature/curved slot end is fixed. By making the zero stop boss move away from the stopping feature/curved slot end in the current invention during the first revolution, multiple additional revolutions are enabled.

By using four start threads 272, 312, the current invention allows for more engagement of zero stop boss 274 with curved slot end 300 than a similar one start thread would (one start maximum engagement for 48 pitch threads would be $\frac{1}{48}$=0.021", whereas four start maximum engagement for 48 pitch threads would be $\frac{1}{48}$*4=0.083"). The use of four start threads also minimizes the amount of variation in that engagement by starting on the correct thread. This can be accomplished by keeping a tight enough tolerance on the height from the curved slot end to where the threads start, in combination with alignment features that indicate which orientation the dial and curved slot end need to be held for the correct thread start to catch and engage when assembling the revolution indicator to the dial. If assembled correctly, the height of the total dial and revolution indicator assembly will be within a band that is the width of 1 thread (48 pitch thread results in a band 0.021" wide) plus the tolerance of the revolution indicator and the dial. Correct assembly can be checked with calipers or a gauge. When installed with one start threads, the engagement of the zero stop boss 274 with the end of the zero stop slot 300 would vary from 0" to 0.021", whereas correctly installed four start threads will allow the use of a 0.021" range of the 0.083" total engagement available. For example, once the tolerance stack is considered, the ideal engagement may be 0.054" to 0.075" to make sure there is always good engagement of the zero stop boss with the curved slot end and the dial and revolution indicator assembly never bottoms out before the zero stop boss engages with the curved slot end. This would not be possible without timed threads using a one start thread and, even if timed threads were used, it would be significantly more susceptible to wear and damage because of the extremely limited 0.021" maximum engagement of the zero stop boss with the curved slot end, which would have to be limited even further due to tolerance considerations. Furthermore, the four start threads allow the revolution indicator to move vertically four times as far per dial revolution as standard one start threads, enabling the zero stop boss on the revolution indicator to be well clear of the curved slot, including the end denoting the zero point, on the second and subsequent revolutions of the dial.

In some embodiments, the zero stop boss 274 could be a separate component that was adjustably threaded into the revolution counter 264 in order to be made from a stronger material and/or to be adjustable to maximize engagement when using single start threads and/or compensate for the variation cause by untimed threads.

In some embodiments, rifle scope with a locking device 200 may include sealing devices and other features to minimize entry of foreign materials, such as dust, dirt, or other contaminants, to help prevent rust, wear, or other damage to the components of the rifle scope with the locking device. The seals may be hermetic seals, and the interior of the main tube 14 may be filled with a dry gas, such as nitrogen or argon, to help prevent fogging that may otherwise be caused by condensation of moisture vapor on surfaces of lenses and other optical elements within the main body. For example, in some embodiments, elevation turret 212 may include a pair of contaminant seals 316, 318 sandwiched between the turret flange 226 and the elevation adjustment spindle 232 to seal any openings or gaps between the two components and the bore 20. The contaminant seals are preferably 0-rings formed of rubber or another elastomeric material, but may be formed by any other suitable sealing material, such as plastic, nylon, or PTFE polymers (e.g., Teflon®).

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While a current embodiment of a rifle scope with a locking device and a current embodiment of a rifle scope with zero stop have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An optic comprising:

a tubular body having an internal movable optical adjustor adapted to shift an image generated by the optic;

a knob connected to the tubular body for rotation about a knob axis and operably connected to the optical adjustor to position the optical adjustor based on a rotational position of the knob;

an indicator skirt operably engaged to the tubular body, non-rotating with respect to the tubular body, and threadedly engaged to the knob;

the indicator skirt being operable to move axially with respect to the knob such that the axial position of the indicator skirt is based on the rotational position of the knob;

an aperture defined by one of the indicator skirt and the knob; and a locking device to mate with the aperture, wherein the locking device is defined by, or coupled to, the other of the indicator skirt and the knob;

wherein the locking device is engaged with the aperture during one or more initial revolutions of a plurality of revolutions of the knob, and one of the locking device and the aperture is arranged to make radial or axial movement with respect to the other of the locking device and the aperture in response to a threshold rotation of the knob, to disengage the locking device from the aperture for one or more subsequent revolutions of the plurality of revolutions.

2. The optic of claim 1 wherein the indicator skirt is threadedly engaged to the knob by threads having a selected pitch providing a selected axial offset of the indicator skirt with respect to the knob from one revolution of the knob, and wherein the indicator skirt has indicia that include rotation indicators spaced apart by a distance corresponding to the selected axial offset.

3. The optic of claim 2 wherein the indicia are a plurality of parallel lines.

4. The optic of claim 1 wherein the indicator skirt is threadedly engaged to the knob by multi-start threads.

5. The optic of claim 1 wherein the indicator skirt is rotationally engaged to the tubular body by way of a channel parallel to the knob axis and a tooth constrained for movement within the channel.

6. The optic of claim 5 wherein the channel is on an interior surface of a bottom end of the indicator skirt.

7. The optic of claim 1 wherein the indicator skirt is constrained to only axial motion with respect to the tubular body.

8. The optic of claim 1 wherein the knob defines a rotation axis, and the indicator skirt and the tubular body include a sliding interface aligned parallel to the rotation axis.

9. The optic of claim 1 wherein the knob defines a rotation axis, and wherein one of the tubular body and the indicator skirt defines an elongated channel parallel to the rotation axis, and the other of the tubular body and the indicator skirt includes a key tooth slidably received in the elongated channel.

10. The optic of claim 1 including indicia on the indicator skirt that remains facing in a rearward direction irrespective of the rotational position of the knob.

11. An optic comprising:

a tubular body having an internal movable optical adjustor adapted to shift an image generated by the optic;

a knob assembly connected to the tubular body for rotation about a knob axis and operably connected to the optical adjustor to position the optical adjustor based on a rotational position of the knob assembly;

a revolution indicator operably engaged to the tubular body, non-rotating with respect to the tubular body, and threadedly engaged to a knob of the knob assembly;

the revolution indicator being operable to move axially with respect to the knob such that the axial position of the revolution indicator is based on the rotational position of the knob;

an aperture defined by one of the revolution indicator or the knob assembly; and a locking device to mate with the aperture, wherein the locking device is defined by, or coupled to, the other of the revolution indicator or the knob assembly;

wherein the knob assembly is adjustable in more than one way to move one of the locking device or the aperture relative to the other of the locking device or aperture, one of which includes rotating the knob assembly a threshold amount.

12. The optic of claim 11 wherein the revolution indicator is threadedly engaged to the knob by threads having a selected pitch providing a selected axial offset of the revolution indicator with respect to the knob from one revolution of the knob, and wherein the revolution indicator has indicia that include rotation indicators spaced apart by a distance equal to the selected axial offset.

13. The optic of claim 12 wherein the indicia are a plurality of parallel lines.

14. The optic of claim 11 wherein the revolution indicator is threadedly engaged to the knob by multi-start threads.

15. The optic of claim 11 wherein the revolution indicator is rotationally engaged to the tubular body by way of a channel parallel to the knob axis and a tooth constrained for movement within the channel.

16. The optic of claim 15 wherein the channel is on an interior surface of a bottom end of the revolution indicator.

17. The optic of claim 11 wherein the revolution indicator is constrained to only axial motion with respect to the tubular body.

18. The optic of claim 11 wherein the knob defines a rotation axis, and the revolution indicator and the tubular body include a sliding interface aligned parallel to the rotation axis.

19. The optic of claim 11 wherein one of the locking device or aperture moves radially with respect to the other of the locking device or aperture, to disengage the locking device from the aperture.

20. The optic of claim 11 wherein the locking device is engaged with the aperture during one or more initial revolutions of a plurality of revolutions of the knob, and one of the locking device or the aperture is arranged to make radial or axial movement with respect to the other of the locking device or the aperture in response to the threshold rotation of the knob assembly, to disengage the locking device from the aperture for one or more subsequent revolutions of the plurality of revolutions.

* * * * *